US006360705B1

(12) United States Patent
Raghavan et al.

(10) Patent No.: US 6,360,705 B1
(45) Date of Patent: Mar. 26, 2002

(54) MECHANISM FOR VARIABLE VALVE LIFT AND CYLINDER DEACTIVATION

(75) Inventors: Madhusudan Raghavan, West Bloomfield; Jie Tong, Troy, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/692,379

(22) Filed: Oct. 19, 2000

(51) Int. Cl.[7] ..... F01L 1/34

(52) U.S. Cl. ..... 123/90.16; 123/90.39; 123/90.41; 123/90.44

(58) Field of Search ..... 123/90.16, 90.15, 123/90.27, 90.39, 90.41, 90.42, 90.43, 90.44

(56) References Cited

U.S. PATENT DOCUMENTS

| | | | | | |
|---|---|---|---|---|---|
| 3,422,803 | A | | 1/1969 | Stivender | 123/90 |
| 5,325,825 | A | * | 7/1994 | Schmidt et al. | 123/90.39 |
| 5,537,962 | A | * | 7/1996 | Fukuzawa et al. | 123/90.16 |
| 5,537,963 | A | * | 7/1996 | Hasebe et al. | 123/90.16 |
| 5,555,860 | A | * | 9/1996 | Wride | 123/90.16 |
| 5,592,907 | A | * | 1/1997 | Hasebe et al. | 123/90.16 |
| 5,622,145 | A | * | 4/1997 | Hara | 123/90.16 |
| 5,642,692 | A | * | 7/1997 | Wride | 123/90.16 |
| 5,692,465 | A | * | 12/1997 | Sawada et al. | 123/90.16 |
| 5,778,842 | A | * | 7/1998 | Schmidt et al. | 123/90.39 |
| 5,899,180 | A | * | 5/1999 | Fischer | 123/90.16 |
| 6,019,076 | A | * | 2/2000 | Pierik et al. | 123/90.16 |
| 6,186,102 | B1 | * | 2/2001 | Kosuge et al. | 123/90.16 |
| 6,295,958 | B2 | * | 10/2001 | Pierik | 123/90.16 |

* cited by examiner

*Primary Examiner*—Teresa Walberg
*Assistant Examiner*—Fadi H. Dahbour
(74) *Attorney, Agent, or Firm*—George A. Grove; Jeffrey A. Sedlar

(57) ABSTRACT

A valve lift mechanism for an internal combustion engine is disposed on the engine cylinder head. The valve lift mechanism has a rocker arm pivotally mounted on the stem of an engine intake valve that is slidably mounted in the cylinder head of the engine. The inlet valve is reciprocated by rocking motion of the rocker arm to control the opening and closing of an inlet passage in the cylinder to thereby control the incoming air/fuel mixture. A contact roller is mounted adjacent one end of the rocker arm on one side of the pivotal mount and a contact surface is formed along the rocker arm on the opposite side of the pivotal mount. A positioning mechanism including a roller is operable to selectively position a contact point between the roller and the contact surface to establish a rocking point for the rocker arm between a maximum lift position for the inlet valve and a minimum lift position of the inlet valve.

3 Claims, 4 Drawing Sheets

MECHANISM FOR VARIABLE VALVE LIFT AND CYLINDER DEACTIVATION

TECHNICAL FIELD

This invention relates to valve controls for internal combustion engines and, more particularly, to controls providing variable valve lift.

BACKGROUND OF THE INVENTION

Internal combustion engines employ intake and exhaust valve mechanisms to control the fuel/air mixture within the engine cylinder. The intake valve controls the incoming charge of fuel and air, and the exhaust valve controls the outgoing products of combustion. The engine operates on a four cycle or stroke principle consisting of intake, compression, power, and exhaust. The intake valve is open for at least a majority of the intake stroke and the exhaust valve is open for at least a majority of the exhaust stroke. Some engines operate with an overlap between the intake and exhaust valves during a change from the intake stroke to the exhaust stroke.

Most engines operate with a stoichiometric air/fuel ratio of approximately 15:1 which will generally support substantially complete combustion of the air/fuel mixture. The combustion of the air/fuel mixture provides the power required to drive the piston in the cylinder during the power stroke. There are valve control systems that control at least the lift or opening amount of the intake valve. The more successful of these systems employ multiple cams or multiple cam followers. The operable portion of these systems is selectively connected with the cam shaft or follower shaft by a clutching mechanism. Other systems have proposed a laterally moveable cam follower to change the valve lift motion. These systems employ complex mechanisms to achieve the desired result of variable valve opening.

One valve control mechanism, described in U.S. Pat. No. 3,422,803 issued Jan. 21, 1969, utilizes a pushrod, a rocker arm, and an adjustable pivot for controlling the valve lift of an intake valve. The rocker arm is a floating member that is held in place by the pushrod, adjustable pivot and the valve stem. The rocker arm does not have a firm connection with any of these members and therefore relies on spring loads and frictional engagement to remain in place. The contact between the adjustable pivot and the rocker arm is a cam-type contact that is positioned between the pushrod contact and the valve stem contact. Each of the contact points has a frictional contact that adds heat to the system and thereby presents a disadvantage by reducing the overall efficiency of the engine.

SUMMARY OF THE INVENTION

It is an object of the present invention to provide an improved valve lift control in an internal combustion engine.

In one aspect of the present invention, a rocker arm is pinned for pivotal movement to the stem of the valve. In another aspect of the present invention, the adjustable pivot and the cam are on opposite sides of the pivot joint at the valve stem. In yet another aspect of the present invention, the contact between the adjustable pivot and the rocker arm is a rolling type contact, as is the contact between the cam and the rocker arm.

DESCRIPTION OF AN EXEMPLARY EMBODIMENT

Figure 1:
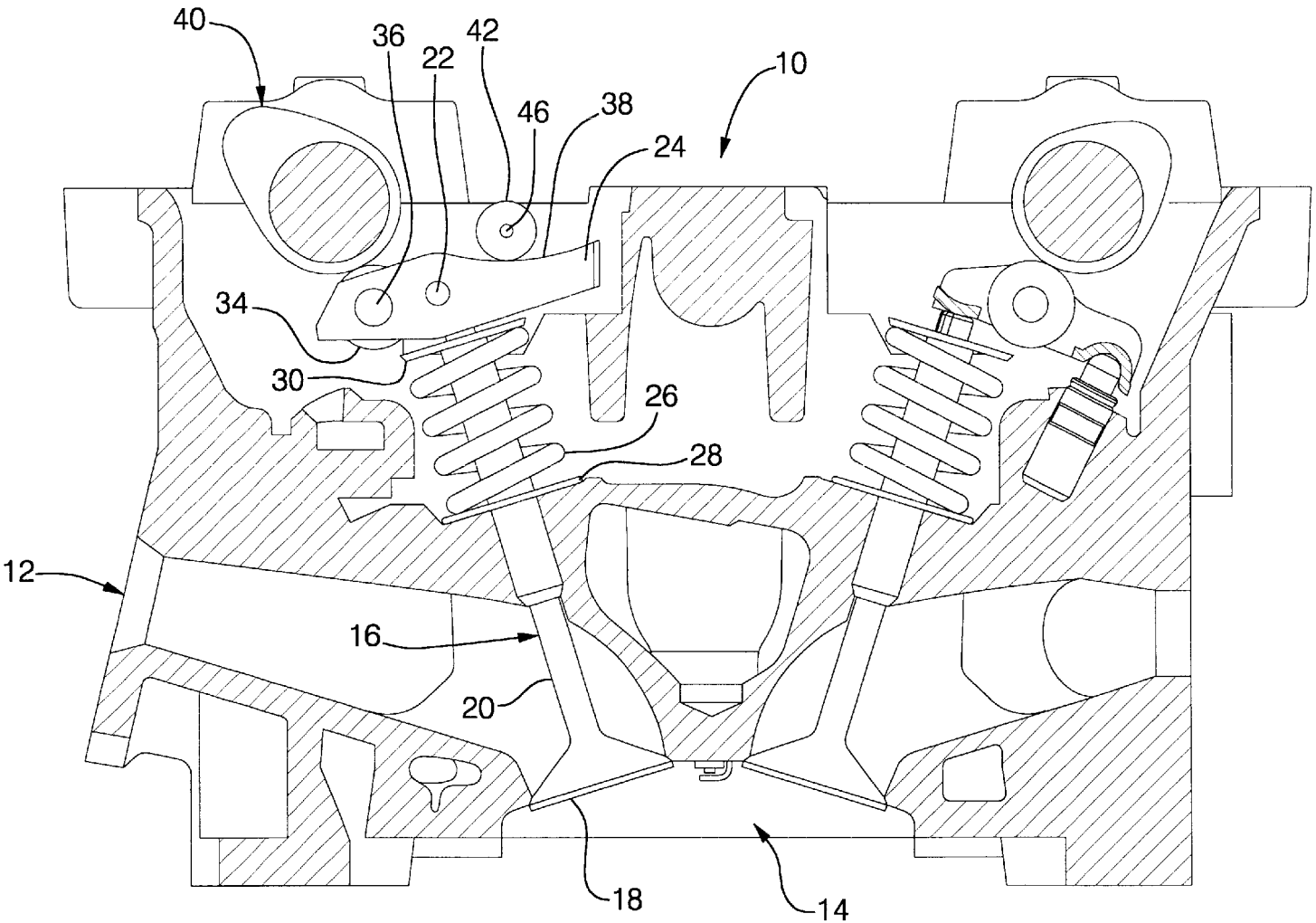
FIG. 1 is a sectional elevational view of a portion of an internal combustion engine incorporating the present invention.

Referring to the drawings wherein like characters represent the same or corresponding parts throughout the several views, there is seen in FIG. 1 a cylinder head 10 having an inlet passage 12 and a portion of a combustion chamber 14. An inlet valve 16 controls fluid flow between the inlet passage 12 and the combustion chamber 14. The valve 16 has a poppet end 18 and a valve stem 20 that is slidably mounted in the cylinder head 10 and connected through a pin 22 to a rocker arm 24. A valve spring 26 is disposed between an abutment 28 on the cylinder head 10 and a spring seat 30 disposed on the valve stem 20. The spring 26 urges the valve 16 to the closed position shown with the poppet end 18 sealingly engaging a valve seat 32 in the combustion chamber 14.

The rocker arm 24 has a roller 34 rotatably mounted thereon by a pin 36 and a contact surface 38. The roller 34 and the contact surface 38 are on opposite sides of the pin 22. The roller 34 is in contact with a conventional cam 40 that is a component on a conventional engine camshaft, not shown. The contact surface 38 is disposed in abutment with a roller 42 that is rotatably mounted on an arm 44 (see FIG. 3) by a pin 46. As the cam 40 is rotated, the rocker arm will pivot about the point of contact 48 formed by the roller 42 and the contact surface 38. The valve 16 will be opened relative to the seat 32 an amount determined by the position of the point of contact 48 relative to the pin 22.

Figure 2:
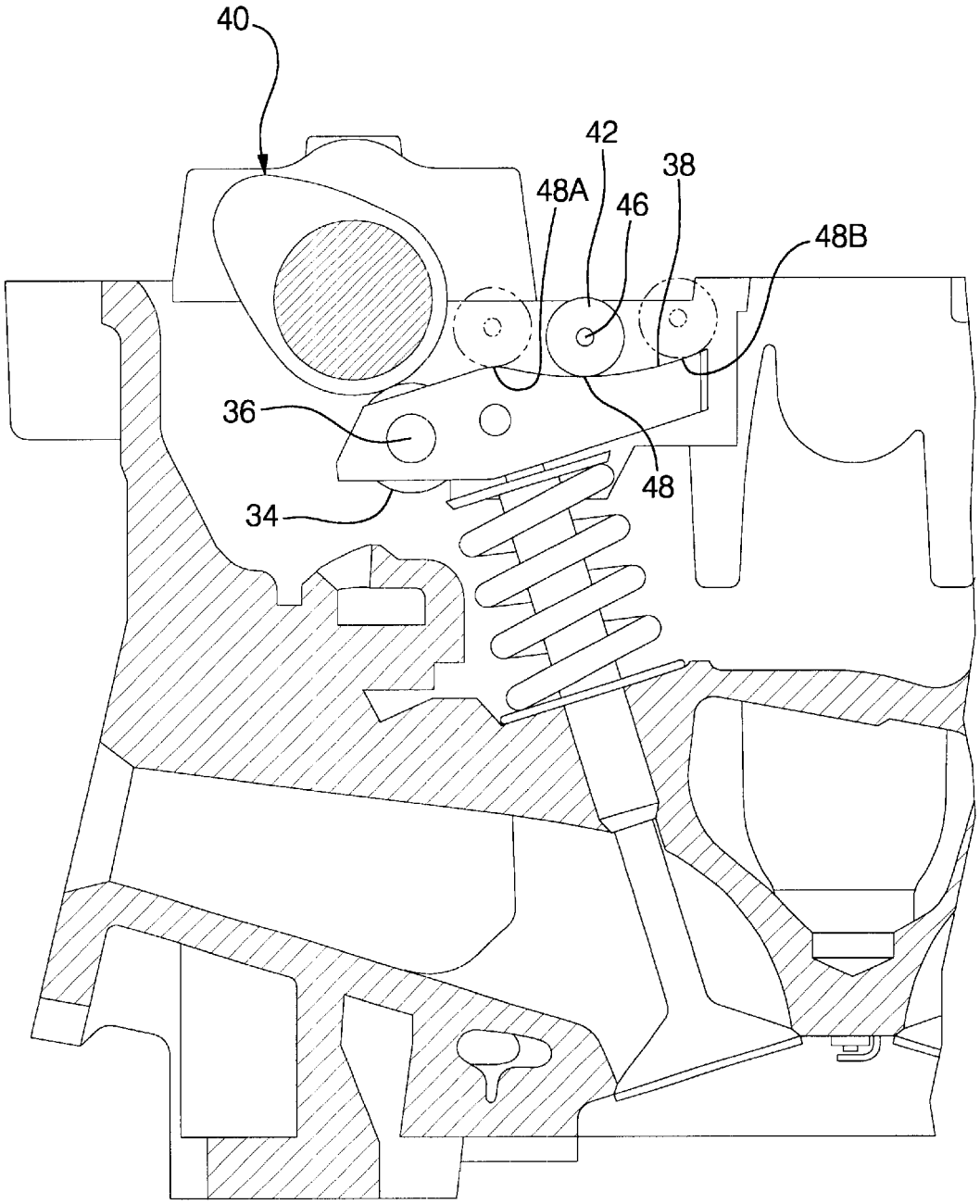
FIG. 2 is similar to FIG. 1 depicting various operating points of the present invention.
Figure 3:
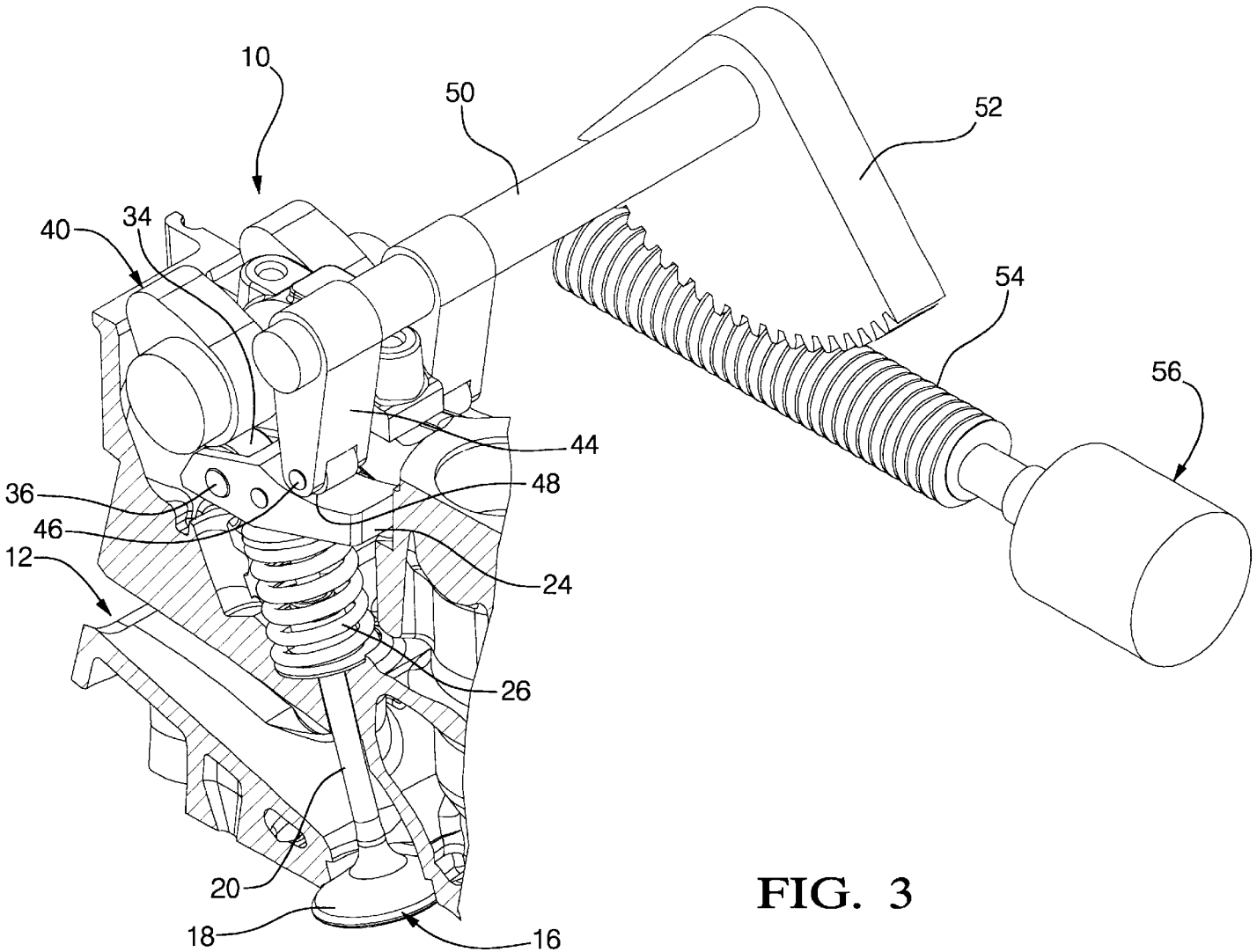
FIG. 3 is an isometric view of a portion of an engine incorporating the present invention.

As best seen in FIG. 3, the arm 44 is secured to a shaft 50 that is rotatably mounted on the cylinder head 10 in a conventional manner, not shown. The shaft 50 has secured thereto a sector gear 52 that meshes with a worm gear 54. The worm gear 54 is selectively rotated by a conventional servo motor 56. As best seen in FIG. 2 when the worm gear 54 is rotated clockwise, the arm 44 is also rotated clockwise to position the roller 42 at a new point of contact 48A that is inboard of the contact point 48. When the worm gear 54 is rotated counterclockwise, the arm 44 is also rotated counterclockwise to position the roller 42 at a point of contact 48B that is outboard of the contact point 48. By controlling the number of revolutions of the worm gear 54, the point of contact of the roller 42 on the surface 38 can be maintained at any position between the points 48A and 48B. The position of the roller 42, as mentioned above, establishes the amount of opening or lift of the valve 16.

Figure 4:
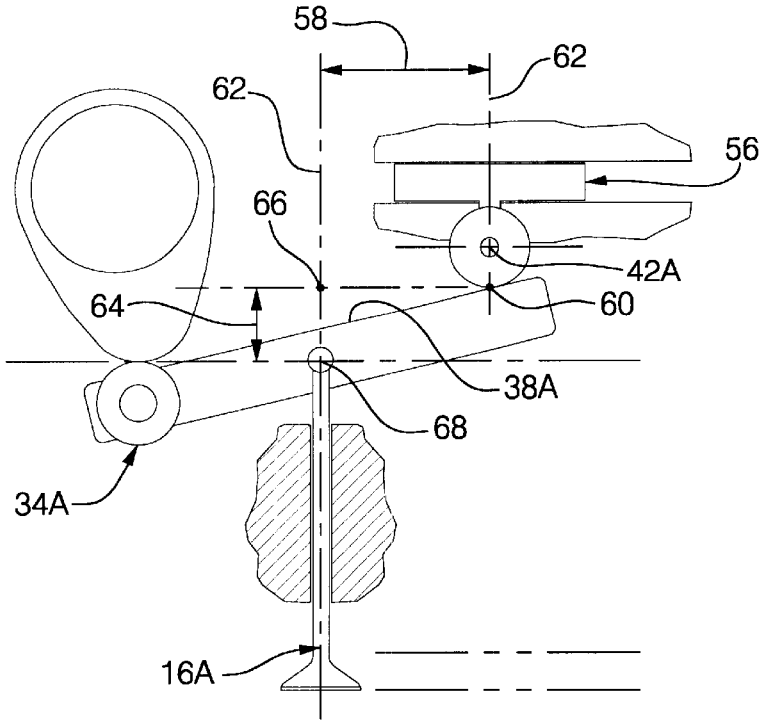
FIG. 4 is a schematic representation of a valve lift system incorporating the present invention depicting a high lift operating position.
Figure 5:
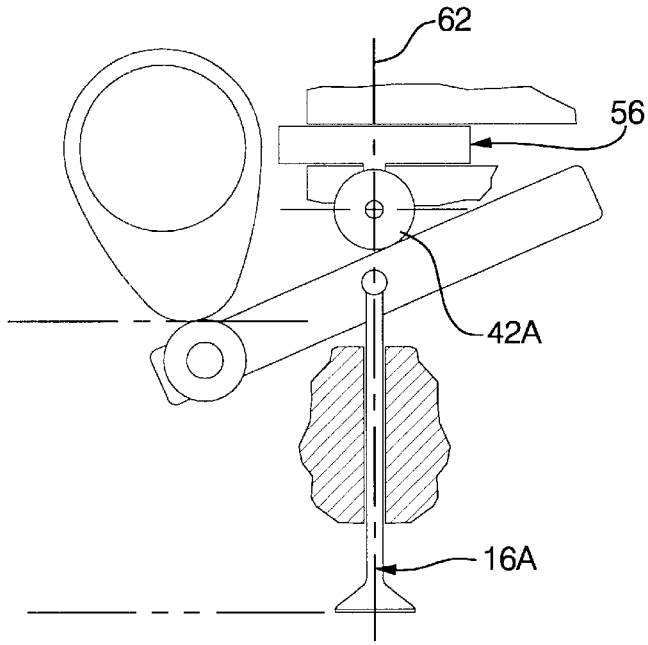
FIG. 5 is a schematic representation of a valve lift system incorporating the present invention depicting a low lift operating position.

The schematic representation in FIGS. 4 and 5 illustrate the lift control imposed on the valve 16 by the roller 42. In the schematic representation, the arm 44 is replaced by a slide mechanism 56 that is moved transversely to the axis of the valve 16A to position the roller 42A along the surface 38A. As seen in FIG. 4, the distance 58 between the point of contact 60 and the longitudinal axis 62 of the valve 16A results in a valve lift distance of 64 as measured from the positions 66 and 68 of the pin 22A. The position 66 represents the closed position of the valve 16A, and the position 68 represents the open position of the valve 16A. The roller 34A is displaced the same value by the cam 40A in both FIGS. 4 and 5. However, the valve lift amount varies between a maximum amount, FIG. 4, and minimum amount, FIG. 5. The minimum amount of valve lift can be substantially zero when the position of the roller 42A is aligned vertically with the longitudinal axis 62 of the valve 16A.

The rocker arm is positioned by the pin 22 and the valve 16. The cam action on the roller 34 and the positioning of the roller 42 present very small frictional forces that are absorbed by the valve stem 20 and the cylinder head 10. The control mechanism for selectively positioning the control roller 42 along the contact surface may employ any of the well-known positioning mechanisms and is not limited to the pivoting arm mechanism described with the exemplary embodiment of FIGS. 1, 2 and 3. For example, a slide mechanism, as suggested in the schematic representations of FIGS. 4 and 5, can be utilized. The control mechanism can be employed to control individual intake valves on a multi-valve engine or to control all or a portion of the intake valves simultaneously.

What is claimed is:

1. A valve lift control mechanism for an internal combustion engine comprising:

an engine cylinder head having an inlet passage;

a valve member slidably disposed in said engine cylinder head;

a spring means for imposing a force on said valve member urging said valve member to close said inlet passage from a combustion chamber;

a rocker arm pivotally mounted on said valve member including a cam contact means disposed on one side of the pivotal mount and a contact control surface disposed on the another side of said pivotal mount;

a rotatable cam means disposed in contact with said cam contact means to cyclically urge said valve to a desired position between minimum valve lift and maximum valve lift;

a control roller contacting said contact control surface; and positioning means for selectively positioning said control roller along said contact control surface between a maximum opening position and a minimum opening position corresponding to said maximum lift and minimum lift.

2. The valve lift control mechanism for an internal combustion engine defined in claim 1 further comprising:

said positioning means including an arm rotatably supporting said control roller and control means for selectively rotating said arm to position said contact between said maximum opening position and said minimum opening position.

3. The valve lift control mechanism for an internal combustion engine defined in claim 2 further comprising:

said control means including a sector gear drivingly connected with said arm, a worm gear meshing with said sector gear, and selectively operable drive motor for rotating said worm gear to thereby rotate said arm to position said roller at a position corresponding to the desired valve lift position.

* * * * *